US005917368A

United States Patent [19]

Tan et al.

[11] Patent Number: 5,917,368

[45] **Date of Patent: *Jun. 29, 1999**

[54] VOLTAGE-TO-CURRENT CONVERTER

[75] Inventors: Nianxiong Tan, Sollentuna; Hans Mikael Gustavsson, Linkoping, both of Sweden

[73] Assignee: Telefonatiebolaget LM Ericsson, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/646,964

[22] Filed: May 8, 1996

[51] Int. Cl.[6] ..... G05F 3/02

[52] U.S. Cl. ..... 327/543; 327/538; 327/103; 323/315

[58] Field of Search ..... 327/538, 540, 327/541, 543, 103; 323/313, 315

[56] References Cited

U.S. PATENT DOCUMENTS

| | | | |
|---|---|---|---|
| 4,445,054 | 4/1984 | Ishii | 327/104 |
| 4,689,607 | 8/1987 | Robinson | 323/316 |
| 4,999,586 | 3/1991 | Meyer et al. | 330/288 |
| 5,118,965 | 6/1992 | Väisänen et al. | 327/129 |
| 5,124,632 | 6/1992 | Greaves | 323/316 |
| 5,231,316 | 7/1993 | Thelen, Jr. | 327/513 |
| 5,237,289 | 8/1993 | Han | 330/277 |
| 5,341,087 | 8/1994 | Van Leeuwen | 323/315 |
| 5,430,337 | 7/1995 | Castello et al. | 327/65 |
| 5,487,787 | 1/1996 | Maekawa et al. | 327/560 |
| 5,570,067 | 10/1996 | Shacter | 331/111 |
| 5,629,614 | 5/1997 | Choe et al. | 323/315 |

FOREIGN PATENT DOCUMENTS

| | | | |
|---|---|---|---|
| 41 15 017 | 11/1992 | Germany . | |
| 406021731 | 1/1994 | Japan | 330/277 |
| 406204757 | 7/1994 | Japan | 330/277 |

*Primary Examiner*—Terry D. Cunningham
*Attorney, Agent, or Firm*—Burns, Doane, Swecker & Mathis, L.L.P.

[57] ABSTRACT

A voltage-to-current converter for converting an input voltage signal into an output current signal, while providing a filtering function. The input voltage signal is converted to an intermediate current signal by an input resistance and an equivalent resistance provided by, for example, an inverting amplifier and a transistor. A current mirror having a dominant pole converts the intermediate current signal to the output voltage signal, and provides low pass filtering. The converter avoids the use of linear capacitors, and can be easily implemented in a CMOS device.

10 Claims, 1 Drawing Sheet

VOLTAGE-TO-CURRENT CONVERTER

FIELD OF THE INVENTION

The present invention generally relates to voltage-to-current converters, such as are used in analog/digital interfaces. More particularly, the present invention provides a voltage-to-current converter having a low pass filtering function.

BACKGROUND OF THE INVENTION

Analog interfaces are used in a variety of digital circuit applications. A typical analog interface is shown in FIG. 1, and includes an anti-aliasing filter and an analog-to-digital (A/D) converter. An analog input voltage is fed to the anti-aliasing filter. The filtered voltage is then fed to the A/D converter and the A/D converter generates digital output signals. The anti-aliasing filter suppresses high-frequency components to avoid aliasing when the analog signal is sampled by the A/D converter.

This conventional "voltage mode" method usually requires linear capacitors; however, modern CMOS baseline fabrication processes (e.g., EPIC 3 and CS11S) do not include the double poly options necessary to create linear capacitors. Thus, the requirement of linear capacitors increases the number of process steps and therefore increases the cost.

In mixed-voltage applications, such as linecard circuits, it is cost-effective to integrate high-voltage and low-voltage circuits on the same chip. Using traditional voltage mode interface circuits, between high-voltage and low-voltage circuits, the high signal swing in the high-voltage circuits must be limited to prevent saturation of or damage to the low-voltage circuits. However, limiting the signal swing reduces the dynamic range of the high voltage circuits.

To overcome the above disadvantages, an alternative "current mode" interface, shown in FIG. 2, can be used. An analog input voltage is first fed to the voltage-to-current (V/I) converter. The output current is passed to the filter and the filtered current is supplied to the A/D converter. Since the interface processes currents instead of voltages, linear capacitors are not necessary, and a pure digital CMOS baseline process can be used without additional processing steps or cost. Also the input voltage to the V/I converter can be arbitrarily larger than the supply voltage of the V/I converter since the V/I converter can be designed to sense only a current swing. This arrangement allows high-voltage and low-voltage circuits to be integrated on the same chip at a low cost.

It would be desirable for an analog digital interface to include both a voltage-to-current conversion capability and a filtering capability, and which can be easily fabricated using a digital CMOS baseline fabrication process such as CS11S.

SUMMARY OF THE INVENTION

The present invention overcomes the above-noted problems, and provides other advantages, by providing a voltage-to-current converter with a filtering function. According to exemplary embodiments, the converter includes an input resistance R and an equivalent resistance $R_i$ for converting an input voltage signal $V_i$ into an intermediate current signal $I_i$, such that $I_i$ is substantially equal to $V_i/(R+R_i)$. The exemplary converter also includes a current mirror having at least two transistors and a dominant pole, the current mirror generating an output current signal $I_o$ from the intermediate current signal $I_i$. The current mirror has a pole frequency $w_p$ substantially equal to $(R_f+1/g_{m1})^{-1}(C_f+C_p)^{-1}$, where $g_{m1}$ is a transconductance of a diode-connected transistor in the current mirror, $R_f$ is a pole resistance between the current mirror transistors, $C_f$ is a pole capacitance between a first and a second terminal of one of the current mirror transistors, and $C_p$ is a parasitic capacitance due to the current mirror transistors.

BRIEF DESCRIPTION OF THE DRAWINGS

A more complete understanding of the present invention can be obtained by reading the following Detailed Description of the Preferred Embodiments in conjunction with the accompanying drawings, in which like reference indicia indicate like elements, and in which.

DETAILED DESCRIPTION OF THE PREFERRED EMBODIMENTS

Figure 1:
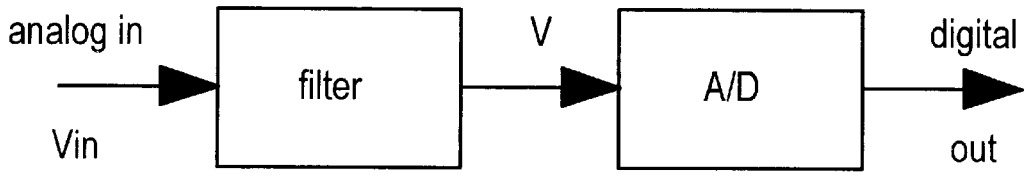
FIG. 1 is a general block diagram of a voltage-mode analog/digital interface.
Figure 2:
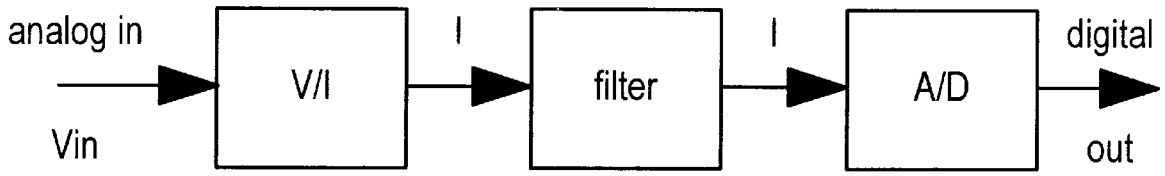
FIG. 2 is a general block diagram of a current-mode analog/digital interface.

Upon comparing FIGS. 1 and 2, it will be appreciated that an extra component (V/I converter) is necessary to utilize the advantages of the current-mode approach, unless the input signal is already a current. The filtering requirements of the anti-aliasing filter are generally low, particularly for applications involving oversampling A/D converters. Therefore, according to the present invention, the V/I converter can be used as the anti-aliasing low-pass filter. The bandwidth of the V/I converter, which is otherwise inherently high, is reduced according to the present invention to provide the benefits of 1) incorporating a low pass filtering function within the V/I converter; and 2) reducing the wideband noise (e.g., thermal noise), since an interface incorporating a circuit according to the present invention has a small bandwidth.

Figure 3:
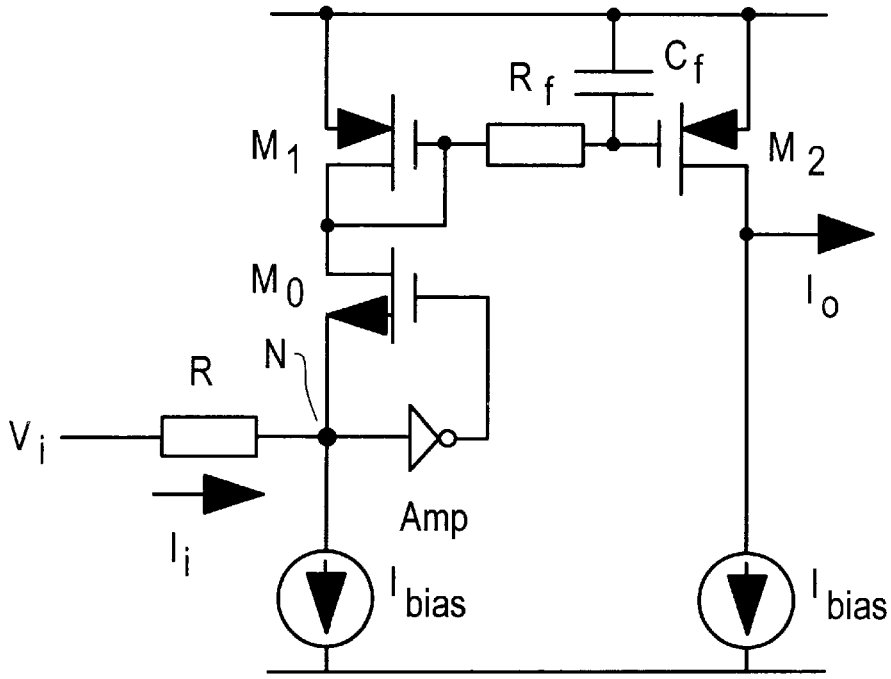
FIG. 3 is a circuit diagram of a low pass filtering voltage to current converter according to an exemplary embodiment of the present invention.

An exemplary circuit configuration for a V/I converter is shown in FIG. 3. The converter 10 includes a resistance R connected between an input voltage $V_i$ and a node N. An inverting amplifier AMP and transistor $M_o$ are connected as shown between the Node N and a current mirror including transistors $M_1$ and $M_2$, resistance $R_f$ and capacitance $C_f$. The sources of transistors $M_1$ and $M_2$, and one terminal of capacitance $C_f$, are connected to a voltage supply line $V_{cc}$, and bias currents $I_{bias}$ flow from the drain of transistor $M_2$ and from node N to a ground line. The output current $I_o$ is the drain current of transistor $M_2$, as reduced by the bias current $I_{bias}$.

Input voltage $V_i$ is directly converted to an intermediate current $I_i$ through resistance R. The relationship is given by $$I_i = \frac{V_i}{R + R_i}$$

Where $R_i$ is the equivalent input resistance at node N, which is signal dependent. If $R_i$ is designed to be very small, then the influence of $R_i$ on the conversion linearity is minimized. This is accomplished by the inverting amplifier AMP as shown in FIG. 3. To the first order, the equivalent input resistance is approximated by $$R_i = \frac{1}{g_{mO}A}$$

where $g_{mo}$ is the transconductance of transistor $M_0$ and A is the voltage gain of the inverting amplifier AMP. Thus, a large voltage gain A of the inverting amplifier AMP will reduce equivalent resistance $R_i$.

It will be appreciated from the above that there are no constraints on the input voltage $V_i$ in the exemplary circuit. Also, the voltage change at the source of $M_0$ is very small due to the low impedance at the node N. In other words, the node N is a virtual ground. Thus, the V/I converter configuration of FIG. 3 is desirable for mixed-voltage applications, such as linecard circuits.

The output current is mirrored out by the current mirror consisting of transistors $M_1$ and $M_2$. Unlike a traditional current mirror, a resistor $R_f$ and a capacitor $C_f$ are employed to purposely introduce a dominant pole in the mirror. The pole frequency is given by $$w_p = \frac{1}{\left(R_f + \frac{1}{g_{ml}}\right)(C_f + C_p)}$$

where $g_{m1}$ is the transconductance of diode-connected transistor $M_1$, and $C_p$ is the overall parasitic capacitance at the gates of $M_1$ and $M_2$.

The use of serial resistance $R_f$ and parallel capacitance $C_f$ in the current mirror limits the bandwidth of the V/I converter, and enables a single-pole low-pass filtering system to be realized in the V/I converter. Unlike in a traditional voltage-mode filter, the voltage change at the gates of $M_1$ and $M_2$ in the circuit of FIG. 3 are small and the demand on the linearity of passive components is significantly reduced. Therefore, well resistors and gate capacitors can be used, and chip area can be significantly reduced even using a standard digital CMOS fabrication process.

In summary, chip area and power consumption can be reduced significantly by utilizing the V/I converter as a low-pass filter according to the present invention. All the components can be realized in a digital CMOS process and therefore the process cost is minimized.

It will be appreciated that the filtering components $R_f$ and $C_f$ can be selected according to the desired filtering characteristics, and that other suitable components may be used.

While the foregoing description includes numerous details and specificities, it is to be understood that these are merely illustrative of the present invention, and are not to be construed as limitations. Many modifications will be readily apparent to those skilled in the art which do not depart from the spirit and scope of the invention, as defined by the appended claims and their legal equivalents.

What is claimed is:

1. A voltage to current converter comprising:

an input resistance R and an equivalent resistance $R_i$ for converting an input voltage signal $V_i$ into an intermediate current signal $I_i$, such that $I_i$ is substantially equal to $V_i/(R+R_i)$; and a current mirror having at least two transistors and a dominant pole, said current mirror generating an output current signal $I_o$ from the intermediate current signal $I_i$, wherein the current mirror has a pole frequency substantially equal to:

$$(R_f+1/g_{m1})^{-1}(C_f+C_p)^{-1}$$

where $R_f$ is a pole resistance between the at least two transistors, $g_{m1}$ is a transconductance of a diode-connected one of the at least two transistors in said current mirror, $C_f$ is a pole capacitance between a first and second terminal of the at least two transistors, and $C_p$ is a parasitic capacitance due to said at least two transistors, wherein the equivalent resistance $R_i$ is the input resistance of the current mirror provided at a common connection of an inverting amplifier having a voltage gain and a transistor having a transconductance therein.

2. The converter of claim 1, wherein the equivalent resistance $R_i$ is inversely proportional to the product of the transconductance of the transistor and the voltage gain of the inverting amplifier.

3. The converter of claim 1, wherein the dominant pole is provided by a resistance connected between gates of at least two transistors and a capacitance between a gate and a drain of one of the at least two transistors.

4. The converter of claim 1, wherein the input resistance R and the pole resistance $R_f$ are well resistors and the pole capacitance $C_f$ is a gate capacitor.

5. The converter of claim 1, wherein pole resistance $R_f$ and pole capacitance $C_f$ perform low pass filtering of the output current signal $I_o$.

6. A method for converting a voltage signal into a current signal, comprising the steps of:

converting an input voltage signal $V_i$ into an intermediate current signal $I_i$, such that $I_i$ is substantially equal to $V_i/(R+R_i)$ where R is an input resistance R and $R_i$ is an equivalent resistance; and generating an output current signal $I_o$ from the intermediate current signal $I_i$, by employing a current mirror having at least two transistors and a dominant pole, wherein the current mirror has a pole frequency substantially equal to:

$$(R_f+1/g_{m1})^{-1}(C_f+C_p)^{-1}$$

where $R_f$ is a pole resistance between the at least two transistors, $g_{m1}$ is a transconductance of a diode-connected one of the at least two transistors in said current mirror, $C_f$ is a pole capacitance between a first and second terminal of the at least two transistors, and $C_p$ is a parasitic capacitance due to said at least two transistors, and wherein the equivalent resistance $R_i$ is the input resistance of the current mirror provided at a common connection of an inverting amplifier having a voltage gain and a transistor having a transconductance therein.

7. The method of claim 6, wherein the equivalent resistance $R_i$ is inversely proportional to the product of the transconductance of the transistor and the voltage gain of the inverting amplifier.

8. The method of claim 6, further comprising the step of:

providing said pole resistance connected between gates of at least two transistors and a capacitance between a gate and a drain of one of the at least two transistors.

9. The method of claim 6, wherein the input resistance R and the pole resistance $R_f$ are well resistors and the pole capacitance $C_f$ is a gate capacitor.

10. The method of claim 6, further comprising the step of:

low pass filtering of the output current $I_o$ using said pole resistance $R_f$ and said pole capacitance $C_f$.

* * * * *